US005640838A

United States Patent [19]

Billner et al.

[11] Patent Number: 5,640,838

[45] Date of Patent: Jun. 24, 1997

[54] APPARATUS AND METHOD FOR EFFECTING YARN PIECING ON AN OPEN-END ROTOR SPINNING MACHINE

[75] Inventors: Werner Billner, Ingolstadt; Josef Breitenhuber, Buxheim, both of Germany

[73] Assignee: Rieter Ingolstadt Spinnereimaschinenbau AG, Ingolstadt, Germany

[21] Appl. No.: 432,087

[22] Filed: May 1, 1995

[30] Foreign Application Priority Data

May 26, 1994 [DE] Germany ..... 44 18 413.1

[51] Int. Cl.[6] ..... D01H 13/26; D01H 4/00

[52] U.S. Cl. ..... 57/263; 57/406; 57/407; 57/408; 57/409; 57/411

[58] Field of Search ..... 57/263, 261, 404, 57/406, 407, 411, 408, 409

[56] References Cited

U.S. PATENT DOCUMENTS

| | | | |
|---|---|---|---|
| 3,662,532 | 5/1972 | Stahlecker | 57/263 |
| 4,022,011 | 5/1977 | Hirai | 57/263 |
| 4,112,659 | 9/1978 | Stahlecker et al. | 57/407 |
| 4,222,225 | 9/1980 | Stahlecker et al. | 57/263 |
| 4,384,451 | 5/1983 | Elias et al. . | |
| 4,497,166 | 2/1985 | Artzt et al. | 57/263 |
| 4,676,059 | 6/1987 | Artzt et al. . | |
| 4,757,678 | 7/1988 | Stahlecker | 57/263 |
| 4,825,631 | 5/1989 | Raasch | 57/263 |
| 5,471,829 | 12/1995 | Billner | 57/413 |

FOREIGN PATENT DOCUMENTS

| | | |
|---|---|---|
| 1932009 | 1/1970 | Germany . |
| 3441677C3 | 9/1988 | Germany . |

*Primary Examiner*—William Stryjewski
*Attorney, Agent, or Firm*—Dority & Manning

[57] ABSTRACT

In preparation of the piecing process in an open-end rotor spinning device, negative pressure is first applied in a housing containing the spinning rotor, and the rotor cover is brought from its operating position into a fiber evacuation position in which it is lifted off from the housing. Fiber feeding is then switched on. The fiber stream produced thereby, together with the air stream which conveys the fibers is deflected and is evacuated by means of the negative pressure prevailing in the housing over the open rotor edge from the interior of the rotor and from the housing, until the rotor cover is brought back into its operating position to convey fibers to the fiber collection groove. To carry out this process, a controllable opening device which is connected to the control device controlling the piecing process, and by means of which the rotor cover can be brought into a fiber evacuation position and into an operating position, and a seal ensuring tightness between the two parts of the fiber feeding channel in both positions of the rotor cover are assigned to the rotor cover.

44 Claims, 5 Drawing Sheets

APPARATUS AND METHOD FOR EFFECTING YARN PIECING ON AN OPEN-END ROTOR SPINNING MACHINE

BACKGROUND OF THE INVENTION

The present invention relates generally to a device and process for piecing on an open-end rotor spinning device, and more specifically on an open-end rotor spinning device with a spinning rotor which is installed in a housing in which negative pressure is applied during the spinning process, whereby fiber feeding is switched on in preparation of the piecing process, but the individual fibers are prevented from being deposited in the fiber collection groove of the spinning rotor and are evacuated by negative pressure until, in synchronization with the back-feeding of the yarn, the fiber evacuation is completed, the fibers are conveyed back into the fiber collection groove to be incorporated into a yarn end being fed back into the spinning rotor, and the drawing off of the yarn is resumed.

In a known process of this type, the fibers to be evacuated are taken in the housing of the opener device over the inlet opening of the fiber feeding channel to a suction channel through which the fibers are evacuated. The evacuation thus prevents deposition of fibers on the fiber collection surface (i.e. in the fiber groove of the spinning rotor) (WO 86/01235 A1). This procedure has the advantage that no openings occur in the fiber conveying path other than those already provided—e.g. a dirt collection opening. Such procedure has the disadvantage, however, that a space and material consuming fiber evacuation and control device is required.

In DE 25 05 943 a process for the preparation of the piecing process is shown. After braking the rotor the feed roller, by means of which fibers of a fiber sliver are conveyed to an opener roller, is caused to rotate for a brief time in order to feed a fiber strand end to the rotor. The fibers in this fiber strand end are removed, together with dust and dirt, by an air stream, whereupon the rotor is again driven. The feed roller then delivers a fiber strand end suitable for piecing via the opener roller into the rotor. In this known process the fibers are constantly guided into the rotor and must be removed again therefrom before the piecing process begins, or the rotor must be cleaned. Because the rotor must stop for fiber removal, the entire piecing process is lengthened.

DE 31 04 444 A1 describes a process in which fibers are prevented from entering the rotor. The fibers are guided along the circumference of the opener roller past the fiber feeding channel and are conveyed into an evacuation channel. Costly design is a disadvantage of this device.

In DE 34 41 677 C3 the fiber stream at the opener roller is also prevented from entering the fiber feeding channel. During piecing a switch-over between the evacuation point and the fiber feeding channel takes place in order to bring the fibers into contact with the introduced yarn end. The switching requires a certain amount of lead time in order to have the fiber stream present in the rotor at the right point in time. This control is relatively expensive.

OBJECTS AND SUMMARY OF THE INVENTION

It is therefore a principal object of the instant invention to create a process and a device by means of which it is possible to avoid the disadvantages mentioned while maintaining the advantages of known processes and devices. Additional objects and advantages of the invention will be set forth in part in the following description, or may be obvious from the description, or may be learned through practice of the invention.

The objects are attained according to the method and device of the invention. To prepare the piecing process, negative pressure in the housing containing the spinning rotor is advantageously activated and the rotor cover is taken out of its operating position into a fiber evacuation position in which it is lifted off from the housing without stopping the sealing action between rotor cover and housing and without air being sucked into the fiber conveying path. The fiber feed is then switched on, and the fiber stream thus produced is deflected, together with the airstream conveying the fibers, by the bundling of the airstream within the spinning rotor caused by the enlargement of the distance between spinning rotor and rotor cover, and is evacuated by means of the negative pressure prevailing in the housing over the open rotor edge from the interior of the rotor and of the housing, until the rotor cover is brought back into its operating position in order to bring fibers back to the fiber collection surface. The bundling of the air stream causes the fibers to be exposed to a more intensive air stream after switching on fiber feed than is normal during spinning operations, causing the fibers to overcome their inertia and to be deflected from their previous flight path to be conveyed over the open rotor edge to the suction channel. In this manner, no fibers reach the fiber collection surface until, due to the return of the rotor cover into its operating position, fiber evacuation is terminated and the fibers are again conveyed to the fiber collection groove to be incorporated into the fiber end, whereby the fiber end, in synchronization with the fiber feed to the fiber collection surface, is readied for piecing by being fed back into the spinning rotor.

In another preferred embodiment of the process according to the invention, the deflection of the fibers to be evacuated is facilitated by lowering the speed of the air which conveys the fibers by introducing auxiliary air into the housing for the time during which the rotor cover is in its fiber evacuation position.

According to yet another preferred embodiment of the process according to the invention, the negative pressure is first applied in the housing containing the spinning rotor. The rotor cover is then brought from its operating position into a fiber evacuation position in which it is lifted so far from the housing that the negative pressure prevailing in the housing is able to draw auxiliary air from the space surrounding the housing without drawing additional air into the fiber conveying path. The fiber feed is then switched on and the fiber stream thus produced, together with the air stream conveying the fibers, is deflected after entry into the interior of the spinning rotor by the lower fiber acceleration caused by the drawing of auxiliary air into the housing and is evacuated over the open rotor edge from the interior of the rotor and of the housing by means of the negative pressure prevailing in the housing, until the rotor cover is again brought back into its operating position for the feeding of fibers to the fiber collection surface. In this manner the fiber deflection and evacuation is facilitated by lowering the speed of the air which conveys the fibers to the spinning rotor.

In order to keep the fiber deflection of the fibers to be removed as minimal as possible, provisions are made in another preferred embodiment of the process according to the invention for the negative pressure which can be applied in the housing to produce an air flow which is oriented substantially in continuation of the feeding direction of the fibers. When the feeding of auxiliary air is provided in still another preferred embodiment it is also preferably oriented substantially in the direction of fiber feeding.

Upon successful piecing, the yarn is again withdrawn from the spinning rotor. In this process, overly sudden yarn withdrawal acceleration must be avoided in order to avoid yarn breakage. To avoid a thick spot following the piecing joint, or at least to render it unobtrusive, it is advantageous for the fibers which are fed to the spinning rotor for incorporation into the yarn end being withdrawn to be adapted in quantity to the acceleration. To adapt the fiber flow fed to the fiber collection surface to the acceleration of the newly pieced and again withdrawn yarn, the evacuated fiber quantity is reduced by bringing the rotor cover from its fiber evacuation position into its operating position in a controlled manner during the run-up of the yarn withdrawal. In addition to, or instead of, the movement control of the rotor cover, provisions can be made to reduce the intensity of the auxiliary air flowing into the housing in a controlled manner during the run-up of the yarn withdrawal to adapt the fiber flow being fed to the fiber collection surface to the acceleration of the newly spun and again withdrawn yarn.

In order to facilitate the fiber deflection for the purpose of fiber evacuation it is advantageous for the fibers not to enter the spinning rotor at an angle in the direction of the fiber collection groove. Thus, in still another preferred embodiment, the fiber stream is deflected before introduction into the spinning rotor so that it is substantially parallel to the plane going through the fiber collection groove.

To carry out the process, the rotor cover may be assigned a seal which ensures a seal between the two elements of the fiber feeding channel when the rotor cover is in its operating position. A controlled opening device may also be provided for bringing the rotor cover into a fiber evacuation position and into an operating position, whereby the rotor cover is lifted in its fiber evacuation position from the housing only so far that the sealing effect between the two elements of the fiber feeding channel is still maintained. The opening device is connected to the control device which controls the piecing process.

In order to avoid turbulence and the catching of fibers which may thereafter come loose and interfere with the spinning process, provisions are made in another preferred embodiment of the device according to the instant invention for the element of the fiber feeding channel installed in the rotor cover to be provided with such an inlet cross-section that even when the rotor cover is in its fiber evacuation position, the element of the fiber feeding channel installed in the rotor cover does not extend into the plane of the outlet cross-section of the element of the fiber feeding channel located in the opener device.

In order to reliably prevent a loss of fibers when the rotor cover is in the fiber evacuation position, an additional seal between the housing and the rotor cover, is provided in a still further preferred embodiment. In this embodiment, the rotor cover can be lifted by the opening device as it is moved into its fiber evacuation position only so far from the housing that the sealing effect between rotor cover and housing is maintained.

In order to allow for a greater lifting movement of the rotor cover while maintaining the sealing effect between rotor cover and housing, it is possible according to the invention to provide the housing with a seal which interacts with the seal of the rotor cover. Preferably the seal of the rotor cover and/or of the housing is made in form of a lip seal.

In order to facilitate the deflection and evacuation of the fibers, an auxiliary air opening controllably connected with the control device and letting out into the housing is provided in the rotor cover according to still another preferred embodiment of the invention. An air flow especially favorable for fiber evacuation is produced when the auxiliary air opening is located essentially on the side of the housing across from the suction air opening relative to the outlet opening of the element of the fiber feeding channel installed in the rotor cover.

In a preferred embodiment of the device according to the invention, the auxiliary air opening is formed by a lip seal of the rotor cover and/or of the housing containing the spinning rotor. The lip seal covers an opening in a snap ring groove which receives the lip seal when the rotor cover is in its operating position and releases the opening in the snap ring groove when the rotor cover is in its fiber evacuation position. Being a function of the position of the rotor cover, the auxiliary air is especially easy to control.

The process and the device according to the instant invention make it possible, in preparation of piecing, to evacuate the fibers so that the fibers which have suffered damage during the stoppage of the fiber feeding device preceding the piecing operation are evacuated and so that perfect fibers are available for piecing. This goal is reached without any intervention being necessary at any point of the fiber conveying path between the fiber feeding device and spinning rotor, so that the device according to the invention has no negative effect upon the normal spinning process. Since the suction device, which is in any case installed at each spinning station to produce the required negative pressure, is used for the evacuation of the fibers, no separate evacuation channel with its control elements is required. As stated, the usual suction device with its standard control device suffices, with the exception that the response moment is changed from that of the previously known process. Only the stroke length of the known opening movements of the rotor cover must be changed according to the instant invention, as well as possibly the seal, in order to achieve the desired sealing effect in the fiber evacuation position of the rotor cover. Overall, changes are to be made mainly in the control, drive and sealing elements of the rotor cover, and these may be retrofit to rotor spinning devices already delivered to the customer. The device is simpler in design than the known devices and even makes it possible to easily control the quantity of fibers to be incorporated during the piecing withdrawal.

Examples of embodiments of the invention are explained in further detail below through drawings.

DETAILED DESCRIPTION OF THE PREFERRED EMBODIMENTS

Figure 1:
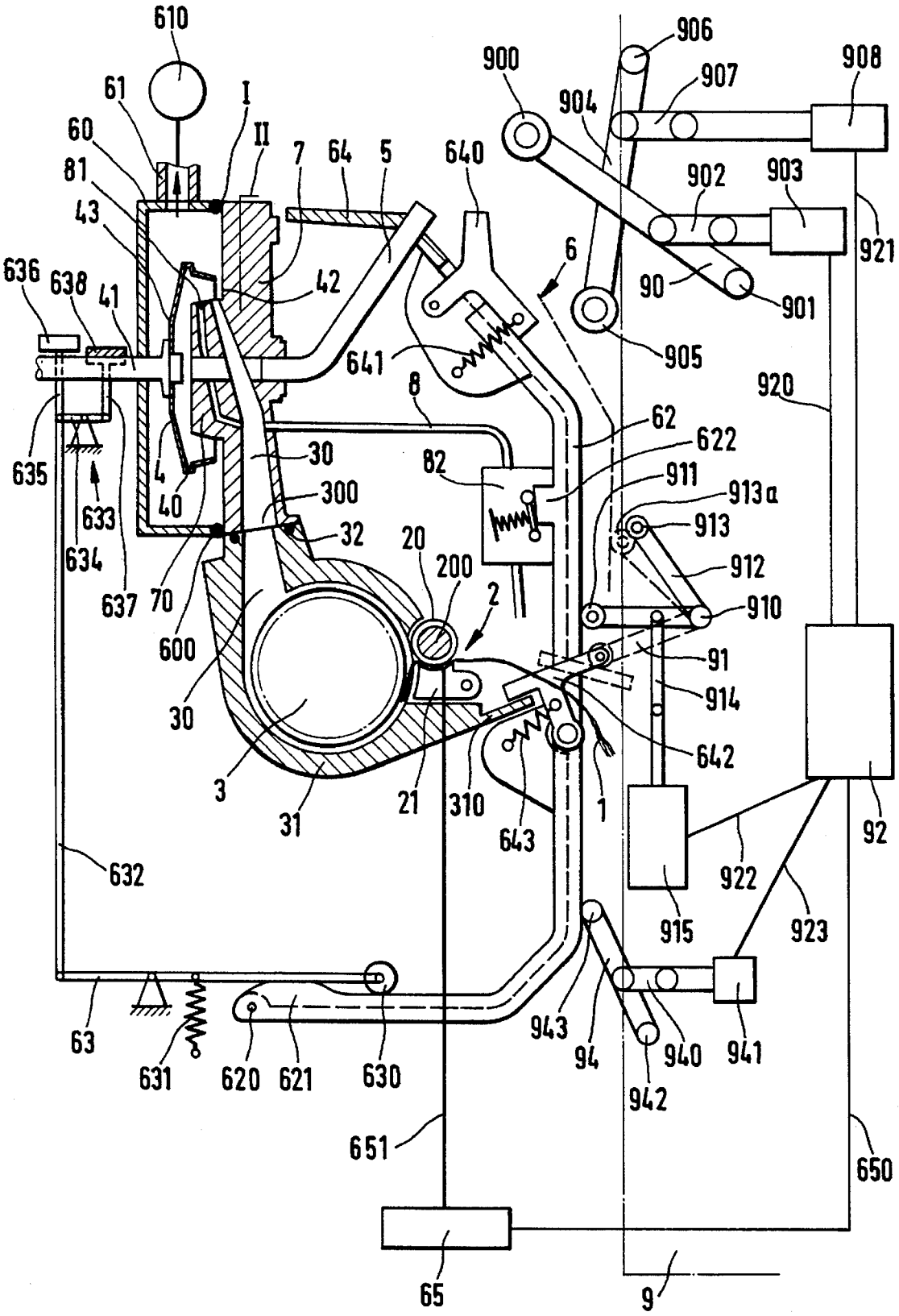
FIG. 1 is a partial cross-sectional and diagrammatic representation of the present invention.

Reference will now be made in detail to the presently preferred embodiments of the invention, one or more examples of which are illustrated in the drawings. Each example is provided by way of explanation of the invention, and not as a limitation of the invention.

The open-end spinning device shown in FIG. 1 is only shown schematically, and elements which are not needed to understand the invention, or which should be understood by those of ordinary skill in this art, have been omitted.

A feeding device 2 is provided to feed a fiber sliver 1 to an opener roller 3. From the opener roller 3 the fiber sliver 1, which has been opened into individual fibers, goes through a fiber feeding channel 30 into the interior of a spinning rotor 4 where the fibers, in the form of a fiber ring, are deposited in a fiber collection groove 40. The fiber ring is continuously spun into the end of a yarn (not shown) which is drawn off through a yarn draw-off pipe 5 by means of draw-off rollers, which are not shown, and is wound up on a bobbin, which is also not shown.

The feeding device 2 of the fiber sliver 1 is provided in the shown embodiment with a driven delivery roller 20 mounted on a through shaft 200 and can be controlled individually by means of coupling not shown here. A feed trough 21 supported pivotably in a known manner by a housing 31 containing the above-mentioned opener roller 3 interacts with the delivery roller 20.

The spinning rotor 4 is supported by supporting disks or similar devices in the usual manner, which is therefore not shown, by means of a shaft 41 and extends through the bottom of a housing 60 which is connected to a source of negative pressure 610 via a suction air connection piece 61. The housing 60 is covered by a rotor cover 7 which supports at least one element of the fiber feeding channel 30 and supports the yarn draw-off pipe 5.

The rotor cover 7 is provided with a cover extension 70 extending into the interior of the spinning rotor 4, in which the outlet opening of the fiber feeding channel 30 and the inlet opening of the yarn draw-off pipe 5 are located. In addition the cover extension 70 contains a blowing channel 81 which is fed by a compressed-air channel 8. The compressed-air channel 8 contains a valve 82 which can be controlled by an extension 622 of a control lever 62.

The control lever 62 is capable of swivelling around a horizontal axle 620 and is provided with a control cam 621 proximate axle 620. In the vicinity of the control cam 621, a roller 630 installed at the end of a two-armed lever 63 bears upon the control lever 62. Lever 63 is subjected to the force of a tension spring 631 so that the roller 630 always remains in contact against the control lever 62.

At the end away from roller 630, the lever 63 is connected to a switch rod 632 which is in turn connected to a rod assembly 633. This rod assembly 633 is shown in FIG. 1 in a very simplified form and is provided in the shown embodiment with a balance lever 634, one end of which is connected via a rod 635 to a brake 636. Its other end is connected via a rod 637 to a mechanism (not shown) for the lifting of a drive belt 638 from shaft 41 or to apply drive belt 638 again on the shaft 41.

The described elements are part of an open-end spinning device 6 which is covered by a cover 64. The control lever 62 is located in a slit of this cover 64 in its shown starting position. The cover 64 supports the previously mentioned valve 82. The cover 64 also supports the previously mentioned rotor cover 7, so that when the cover 64 is opened, the rotor cover 7 is also removed from the open side of the spinning rotor 4 and from housing 60.

The cover 64 furthermore supports an actuating lever 640 which holds the control lever 62 in the shown position by means of a tension spring 641 against the effect of the tension spring 631 manifesting itself on the control lever 62 and acting upon lever 63.

The cover 64 supports also an unlocking or release lever 642 which is subjected to the force of a tension spring 643 and is thereby held in the shown locking position in which the release lever 642 reaches behind a projection 310 of the housing 31. The unlocking and release lever 642 enables the lifting of the rotor cover 7 from the housing 60.

To actuate the release lever 640, an actuating lever or actuating arm 90 is provided. Actuating arm 90 is mounted pivotably on a piecing apparatus 9 which is able to travel alongside the open-end spinning machine adjoining a plurality of identical work or spinning stations, each with an open-end spinning device 6. The actuating arm 90 supports a roller 900 on its free end, is pivotably mounted on an axle 901, and is connected via a coupling element 902 to a swivel drive 903.

To bring back the control lever 62 into its starting position in alignment with the cover 64, a resetting lever 904 with a roller 905 on its free end is provided on the piecing apparatus 9. The resetting lever 904 is capable of swivelling around an axle 906 and is connected by means of a coupling element 907 to a swivel drive 908.

Similarly, for the actuation of the release lever 642, an actuating lever or actuating arm 91 is provided which can be swivelled around an axis 910 and which supports a roller 911 on its free end. A stop, in the form of a stop arm 912, is interlockingly connected to the actuating arm 91 and is mounted for that purpose on the same axle 910. This stop arm 912 supports a stop roller 913 on its free end. The actuating arm 91 is connected via a coupling element 914 to a swivel drive 915.

To bring the cover 64 into its closed position, a resetting lever 94 is provided on the travelling piecing apparatus 9. Resetting lever 94 is capable of swivelling around an axle 942 and has a roller 943 at its free end. Resetting lever 94 is connected to a swivel drive 941 via a coupling element 940.

The actuating arm 91, with its drive, and the release arm 642 together constitute an opening device for the rotor cover 7 to which, as shall be explained in further detail, at least two work positions (positions I and II) are assigned. In addition the rotor cover 7, together with the cover 64, can also be brought in a known manner into a rest position in which the cover 64 is opened to such an extent that the open-end spinning device 6 and its aggregates are accessible.

The swivel drives 903, 908, 915 or 914 are connected respectively via a control circuit 920, 921 or 923 to a control device 92 of the piecing apparatus 9, which is in turn connected via a control circuit 650 to a control device 65 on the machine. The control device 65, which controls several functions not discussed here, is, among other things, also connected via a control circuit 651 for control purposes to the above-mentioned coupling (not shown) of the delivery roller 20.

The composition of the open-end spinning device 6 and of the piecing apparatus 9 having been described above, the function of this device shall now be described in connection with piecing.

During the normal spinning process the fiber sliver 1 is fed in the usual manner to the spinning rotor 4, after having been opened into individual fibers, and is incorporated into the end of a yarn which leaves the spinning rotor 4 through the yarn draw-off pipe 5.

If piecing is to be carried out at a spinning station, which was for some reason out of operation until then, the negative spinning pressure—if it was switched off by the breaking of the connection between suction air connection piece 61 and source of negative pressure 610—is brought into action again, and the spinning rotor 4 is again driven.

To initiate the spinning process, the control device 92 of the piecing apparatus 9 actuates the swivel drive 903. Swivel drive 903 presses roller 900 of the actuating arm 90 against the actuating lever 640 and thereby releases the control lever 62. Control lever 62 is now pushed out of the mentioned slit in the cover 64 in direction of the piecing apparatus 9 under the effect of the tension spring 631. Control lever 62 with its extension 622 thereby releases the valve 82 which, in turn, releases the compressed-air channel 8 so that compressed air enters the blowing channel 81.

Simultaneously with the swivelling of the control lever 62, the drive belt 638 is lifted from shaft 41 of the spinning rotor 4 via lever 63, the switch rod 632 and the rods 633, and the brake 636 is brought to lie against shaft. The spinning rotor 4 is thus braked until stoppage. During this braking of the spinning rotor 4 the compressed air discussed above goes through blow channel 81, enters the interior of the spinning rotor 4, and sweeps over the entire circumference of the spinning rotor 4, thereby cleaning spinning rotor 4.

During rotor cleaning the yarn end to be pieced is fed back in a known manner from the bobbin, possibly a special piecing bobbin, to the open-end spinning device 6 after having been given an optimal form for piecing in the usual manner. Due to the negative pressure of the source of negative pressure 610, the yarn with its piecing end is brought into a defined piecing position within the yarn draw-off pipe 5.

To complete the cleaning process the swivel drive 908 is actuated from the control device 92, and the control lever 62 is again brought into alignment with the cover 64 by means of the roller 905. Simultaneous actuation of the swivel drive 903 causes the roller 900 of the actuating lever 640 to be pushed aside. The roller 900 then again releases the actuating lever 640, which now catches behind the upper end of the control lever 62. The roller 905, which is no longer needed, is again drawn back. The return of the control lever 62 in its catch position in the cover 64 causes the spinning rotor 4 to be released by the brake 636 and to be started up again by the drive belt 638, which now is again pressed against shaft 41.

To prepare the piecing process, the rotor cover 7 is lifted up from housing 60, and thereby from the open edge 42 of the spinning rotor 4, and is brought into an evacuation position (position II) after the control lever 62 catches in the cover 64. The interior of housing 60 is thereby connected via a gap between rotor cover 7 and housing 60 to the air surrounding said housing 60.

This opening of the rotor cover 7 is controlled by the travelling piecing apparatus 9. For this purpose the swivel drive 915, which presses the actuating arm 91 with its roller 911 against the release arm 642, is actuated from the control device 92. As a result the release lever 643 is unhooked from the projection 310 of housing 31. Cover 64 drops in the direction of the piecing apparatus 9 as a result of gravity until coming into contact with the stop roller 913, which now assumes position 913*a* (see hatched representation). This tilting of the cover 64 is due to the fact that the entire mass of cover 64, and of the parts connected to it, is located on the side of axle 620 towards the piecing apparatus 9 in relation to the axis 620.

The coupling (not shown) of the delivery roller 20 is now actuated from the control device 92 via the control device 65 on the machine in such manner that the fiber feed to the opener roller 3 is resumed. The fibers combed out of the forward end of the fiber sliver 1 thus enter the fiber feeding channel 30. Since the rotor cover 7 assumes position II, in which auxiliary air is sucked from the space surrounding housing 60 through the gap between rotor cover 7 and housing 60 due to the negative pressure produced by the source of negative pressure 610, the negative pressure exerted by the source of negative pressure 610 in the fiber feeding channel 30 is lowered. The acceleration of the air which conveys fibers within the fiber feeding channel 30 is therefore also reduced as compared to normal spinning operation, when the rotor cover 7 assumes its operating position (position I), in which no air can penetrate the housing 60 between housing 60 and the rotor cover 7.

Because of reduced air speed and because of the lower fiber acceleration and speed caused thereby, the fibers have a lower inertia than in the normal spinning process. The fibers therefore more easily follow the conveying air stream sucked over the open rotor edge (edge 42 of spinning rotor 4) into the suction air connection 61 and are evacuated together with the air stream. This evacuation of the fibers is further facilitated because, due to the lifting of the rotor cover 7 from the housing 60 and transfer into its position II, the deflection required for the evacuation of the air and the fibers is in any case lower than during the normal spinning process when the rotor cover 7 is in its position I.

Due to the stoppage of the fiber sliver 1 during the time preceding piecing, and/or while the opener roller 3 continues to run, the forward end of the fiber sliver 1 is subjected to the combing action of the opener roller 3, causing this forward sliver end to be diminished, shortened and tangled. This sliver end is thereby given a length range which is not, or only conditionally, suitable for piecing. The injury done to the sliver end depends on the stoppage time of the feeding device 2 while the opener roller 3 is running.

The evacuation of the fibers immediately before the actual piecing process causes the portion of fiber sliver 1 which is undesirable for piecing to be evacuated. As soon as this has occurred, and in mutual synchronization, the yarn end is delivered back into the spinning rotor 4, into its fiber collection groove 40. By returning the rotor cover 7 into its operating position (position I) (by means of the resetting lever 94 and its roller 943) the fibers are delivered into the fiber collection groove 40 of the spinning rotor 4 where the fibers and the yarn end combine. The yarn is then withdrawn from the fiber collection groove 40 of the spinning rotor 4 as the fibers are continuously incorporated in it and is wound up on a bobbin (not shown). The piecing process is thus completed.

At this moment at the latest, all operating elements of the piecing apparatus 9 return to their starting positions, whereupon the piecing apparatus 9 is again able to resume its travel along the rotor spinning machine.

Since the fibers which are unsuitable for spinning, and which are therefore undesirable, are evacuated over the open rotor edge, no intervention is necessary in the normal fiber conveying path between the fiber feeding device 2 and the outlet into the fiber feeding channel 30. As a result, fiber conveying into the spinning rotor 4 during the spinning process cannot be disturbed in the least. In addition, there are practically no time differences between the change in the fiber conveying path (first for the evacuation of the fibers into the suction air connection piece 61, and then into the spinning rotor 4 to collect the fibers in the fiber collection groove 40) since the deflection point is located in the area of the rotor. Synchronization between the entry of the fiber flow in the spinning rotor 4 and the back-feeding and resumed withdrawal of the yarn during piecing can thus be achieved in a most precise manner.

As shown in FIG. 1, the inlet opening 300 of the part of fiber feeding channel 30 located in the rotor cover 7 is of sufficient size so that the part of the fiber feeding channel 30 located in the rotor cover 7 does not extend into the plane of the outlet cross-section of the part of fiber feeding channel 30 located in the opener device either in position I nor in position II. The fibers emerging from the part of the fiber feeding channel 30 located in housing 31 are thus able to go through projecting edges and into the part of the fiber feeding channel 30 located in the rotor cover 7. The part of fiber feeding channel 30 with the inlet opening 300 is made for this reason in form of a funnel and is sized accordingly. In addition, a seal 32 is provided in the housing 31 (and/or in the rotor cover 7) which ensures a tight seal between housing 31 and the rotor cover 7 and excludes the aspiration of air into the fiber conveying path, whether the rotor cover 7 is in position I or in position II.

In order to prevent an escape of fibers between the rotor cover 7 and the housing 60 containing the spinning rotor 4, no special measures are to be taken as a rule, since the air stream entering through the gap formed between the rotor cover 7 and the housing 60 take the fibers back into housing 60 and convey them to the suction air connection piece 61. In order to increase the certainty that no fibers can escape here, however, it is also possible to provide, in an alternative embodiment of the described device, for the housing 60 and/or the rotor cover 7 to (each) be provided with a seal 600 designed to seal off the interior of the housing not only in position I of the rotor cover 7, but also in its position II against the atmosphere surrounding the housing 60.

When the sealing effect between the rotor cover 7 and the housing 60 is not cancelled out, a bundling of the air stream inside the spinning rotor 4 and over its open edge 42 is caused due to the lengthening of the distance between the spinning rotor 4 and the rotor cover 7. This bundling occurs because the air coming out of the fiber feeding channel 30 takes the shortest path to the suction air connection piece 61, while the air leaving the spinning rotor 4 flows in a manner distributed over the circumference over the open edge 42 of the spinning rotor 4 while the rotor cover 7 is in position 1 in order to allow for the required air throughput.

Figure 3:
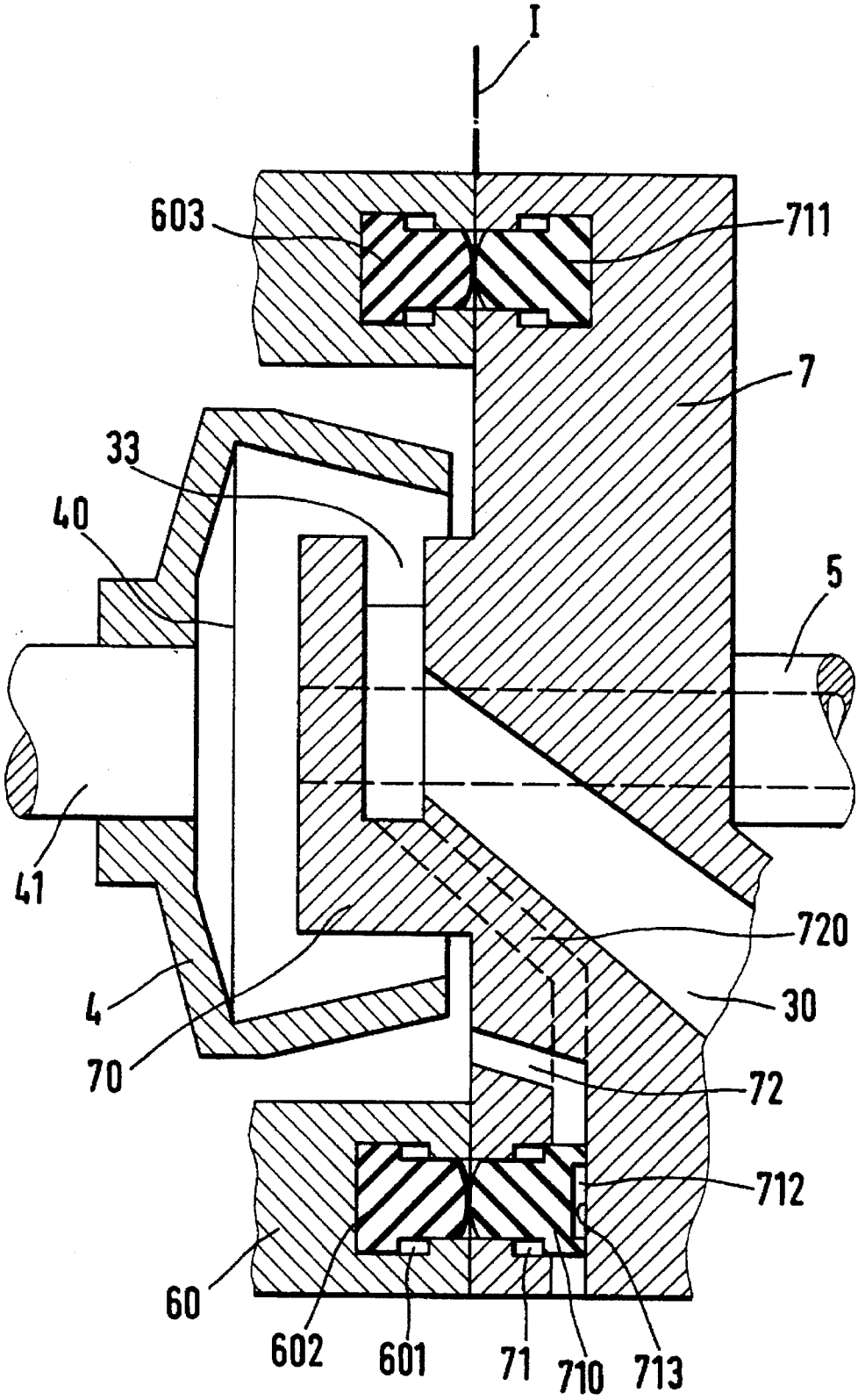
FIG. 3 is a partial cross-section representation of a rotor housing assembly according to the present invention.
Figure 4:
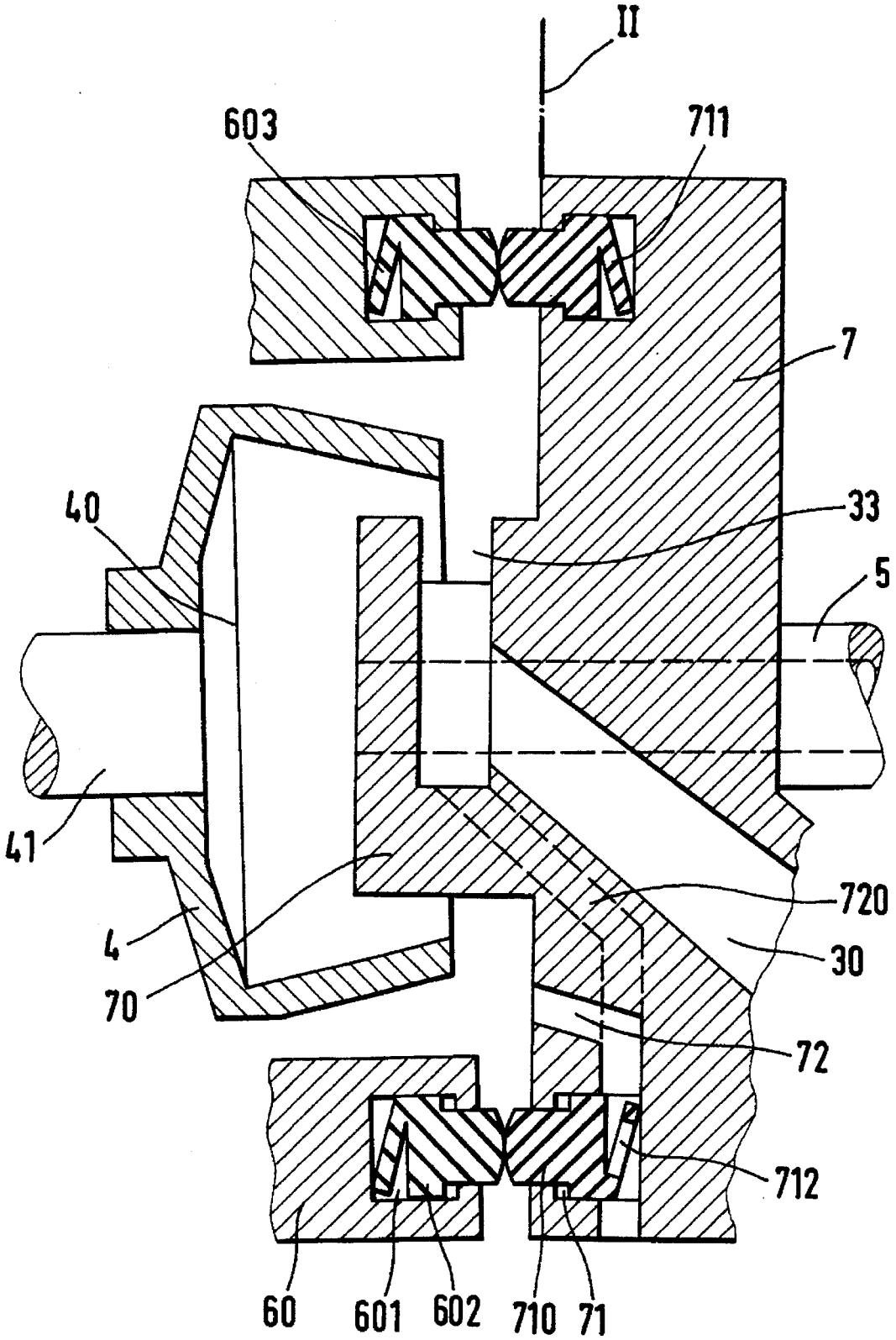
FIG. 4 is a partial cross-sectional representation of a rotor housing assembly according to the present invention.

An example of an embodiment in which the sealing effect between the rotor cover 7 and the housing 60 is maintained also in position II of the rotor spinning cover 7 is shown in FIGS. 3 and 4. FIG. 3 shows the rotor cover 7 in its position I, i.e. in its operating and closed position, and FIG. 4 shows rotor cover 7 in its position II, i.e. in its fiber evacuation position.

The housing 60 containing the spinning rotor 4 as well as the rotor cover 7 is provided with an undercut snap ring groove 60 or 71 in which a lip seal 602 or 710 extending from the snap ring groove 601 or 71 is placed.

As shown in FIG. 3, the lips 603 and 711 are pressed against the basic body of the lip seals 602 and 710 for as long as the rotor cover 7 is in its position I. When the rotor cover 7 is, however, brought into its position II, the lips 603 and 711 spread away from the basic bodies of the two lip seals 602 and 710 and push the basic bodies of the lip seals 602 and 710 out of the snap ring grooves 601 and 71 as far as this position of the rotor cover 7 allows. FIG. 4 clearly shows that position I of the rotor cover 7 and the lip seals 602 and 710 are coordinated with each other in such manner that the sealing effect between the lip seals 602 and 710, and thereby also between rotor cover 7 and housing 60, is still ensured as before, even when the rotor cover 7 is in position II.

Contrary to the device explained through FIG. 1, no air enters the housing 60 at this location. Instead, the negative pressure produced by means of the source of negative pressure 610 is able to take full effect in the interior of the rotor. The fibers are accelerated in this manner, but, as a result of the intensified bundled suction air stream, they are safely conveyed to the suction air connection piece 610. This is further facilitated—as by means of the device shown in FIG. 1—in that the outlet of the fiber feeding channel 30, when the rotor cover 7 is in position II, has been moved slightly out of the spinning rotor 4, so that the fibers do not experience any great deflection on their path over the open edge 42 of the spinning rotor 4.

Fiber guidance can be further facilitated for the spinning process, as well as for the fiber evacuation immediately before the actual piecing, if the fibers are not fed at an angle to the plane going through the fiber collection groove 40 into the spinning rotor (see FIG. 1) but go from the fiber feeding channel 30 into a slit 33 which is oriented parallel to the above-mentioned plane. During spinning the fibers reach one and the same level line on the inner wall of the spinning rotor 4, resulting in particularly even deposit of fibers in the fiber collection groove 40 so that, qualitatively, an especially good yarn is spun. If, however, the rotor cover 7 is in its fiber evacuation position (position II), fiber evacuation is especially facilitated in that the fibers are reoriented from their fiber feeding direction, which they were given in the fiber feeding channel 30, into a plane parallel to the plane going through the fiber collection groove 40 and thereby also to the plane going through the open edge 42 of the spinning rotor 4. Slit 33, in position II of the rotor cover 7, is already lifted to a certain extent out of the interior of the spinning rotor 4. Thus, a large portion of the fibers leaving slit 33 need not undergo any deflection in order to fly over the open edge 42 of the spinning rotor 4 to reach the space surrounding the spinning rotor 4 inside housing 60.

In order to minimize the deflection of the fibers emerging from fiber feeding channel 30 and fed to the suction air connection piece 61, the suction air connection piece 61 is placed substantially in prolongation of the fiber feeding channel 30. As a result, the source of negative pressure 610 produces an air flow in the spinning rotor 4 which is oriented substantially in continuation of the feeding direction of the fibers leaving the fiber feeding channel 30, thus facilitating fiber evacuation because the deflection of the conveying air is as minimal as possible in this case.

It has been shown that it is an advantage for the fiber evacuation to be assisted in principle in its evacuation direction by an air stream fed from the rear extension of the fiber guiding direction. In principle, and independently of whether the rotor cover 7 is sealed off from housing 60 or not in its position II, a controlled air feed connection piece (not shown) can let out into the housing 60 across from the suction air connection piece 61 in order to introduce auxiliary air into the housing 60 during fiber evacuation. This auxiliary air stream facilitates the feeding of the fibers to the suction air connection piece 61 because it is oriented substantially in the direction of fiber feeding.

Advantageously, this conveyed air stream is guided so that it reaches the spinning rotor 4 from the side across from the suction air connection piece 61 and leaves the spinning rotor 4 again in the area of the outlet of the fiber feeding channel 30, taking with it the fiber stream which leaves the fiber feeding channel 30 over the open edge 42 of the spinning rotor 4. In this case, as shown in FIG. 1, the fiber feeding channel 30 is essentially oriented in the direction of the suction air connection piece 61, relative to the plane of the drawing. In such case an air feeding channel 72 of this type is installed in the rotor cover 7 and (in deviation from the design shown in FIGS. 3 and 4) is equipped with an outlet opening which lets out as directly as possible into the spinning rotor 4 within the circular surface enclosed by the open edge 42 of the spinning rotor 4.

Another alternative solution is shown by broken lines in FIG. 3 and 4. According to this solution, an air feeding channel 720 lets out—relative to the conveying direction—behind the outlet opening of the fiber feeding channel 30 into slit 33 so that the fibers are subjected to the air stream entering through slit 33 from the time they reach the slit 33 and are fed to the suction air connection piece 61.

Although different characteristics of the invention were shown in combination in FIGS. 3 and 4, it should be understood by those of ordinary skill in the art that within the framework of the instant invention, other combinations are also possible and that individual elements or features of one embodiment may be replaced by other suitable elements or features. Thus it is, for example, not necessary to provide a valve controlled from the outside to control the flow of arriving air in the arriving air opening or in the air feeding channel 72 or 720. As shown in FIGS. 3 and 4, it is possible to couple air feeding through the air feeding channel 72 or 720 to the movement between positions I or II of the rotor cover 7. In the embodiment of the spinning device shown in FIGS. 3 and 4, the lip 711 of the lip seal 710 of the rotor cover 7 is, for example, made in the form of a valve. For this purpose, the lip 711 is provided with a window 712 which presses, in position I of the rotor cover 7, against the bottom 713 of the snap ring groove 71 and is thus covered, i.e. closed.

FIGS. 3 and 4 show that the air feeding channel 72 or 720 are installed radially relative to the spinning rotor 4. The air feeding channel is installed in such manner here that it traverses the snap ring groove 71.

For as long as the window 712 is pressed against the bottom 713 of the snap ring groove 71, the air feeding channel 72 or 720 is interrupted in the area of the snap ring groove 71 by the lip seal 710 (position I of the rotor cover 7). If the rotor cover 7 is, however, in its fiber evacuation position (position II), the lip 711 spreading away from the basic body of the lip seal 710 frees the window 712, which now allows air to flow through. When the rotor cover 7 returns into its operating position (position I), the air flow-through is again stopped.

It should be understood that different seals can be used instead of a lip seal 602. In this case, seal 602 may also, depending on design, control an air arrival opening if necessary. It is however also possible, if this is at all desired, to provide an air supply opening which, although it can be controlled in dependency of position I or II of the rotor cover 7, works nevertheless independently of the seal.

A modified embodiment of the device, through which a depositing of fibers on the fiber collection groove 40 before actual piecing is prevented, shall be described below through FIG. 2. Here too, the sealing effect between housing 60 and the rotor cover 7 is maintained when the latter is in its position II.

Figure 2:
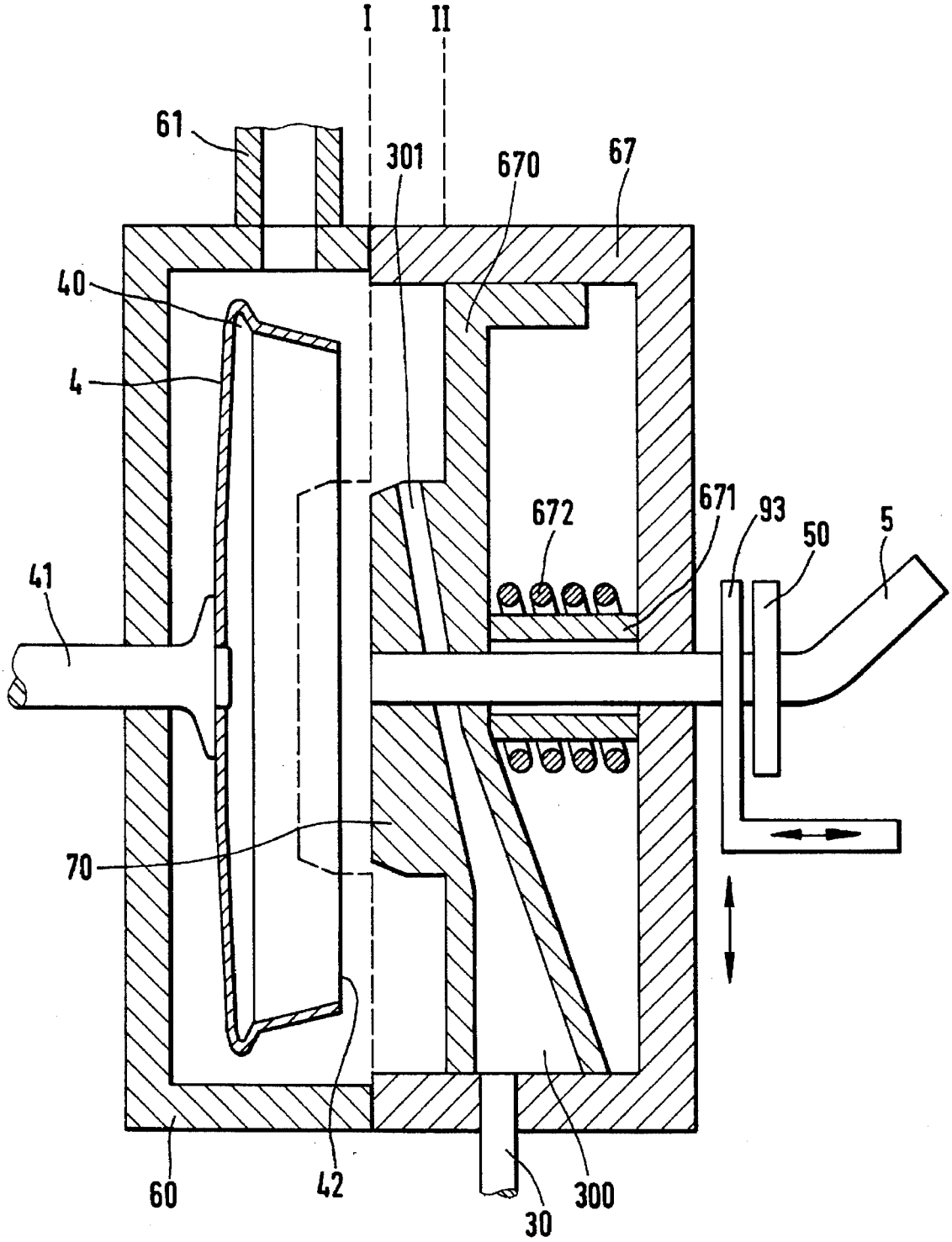
FIG. 2 is a cross-sectional representation of a rotor housing assembly according to the present invention.

As shown in FIG. 2, the housing 60 can be covered by a cover 67 which receives a rotor cover 670 capable of displacement. This rotor cover 670 is able to assume a first position I, the operating position during the normal spinning process relative to the cover 67 while the position of cover 67 remains unchanged. Rotor cover 670 may also assume a second position II, the fiber evacuation position during preparation of piecing. A sleeve 671, within which lies the yarn draw-off pipe 5 which is in turn connected rigidly to the rotor cover 670 and is provided on its end outside cover 67 with a stop ring 50 with which a fork 93 is able to interact, is provided to guide the rotor cover 670 in the cover 67.

The fork 93 is mounted on the piecing apparatus 9 (FIG. 1) and can be moved in a horizontal as well as a vertical direction in such manner that it is able to go into the shown stop position. In the stop position, fork 93 interacts with stop 50. Fork 93 can also be moved back out of this stop position.

A compression spring 672 bears, on the one side, upon the inner wall of the cover 67 and, on the other side, on the radial surface of rotor cover 670 towards the forward face of the cover 67. The rotor cover 670 is provided with a cover extension 70 in which a segment 301 of the fiber feeding channel 30 is located.

In an operating position, the rotor cover 670 assumes position I, shown by broken lines, in which the segment 301 constitutes the continuation of the fiber feeding channel 30. If the fiber stream is now to be fed over the rim 42 of the spinning rotor 4 to the suction air connection piece 61 in order to end fiber feed to the fiber collection groove 40, the rotor cover 670 is brought into position II by means of the fork 93 which interacts with stop ring 50. The segment 301 of the fiber feeding channel 30 is of such size that even in this position of rotor cover 670 the fibers reliably go into the segment 301. Here, provisions are again made such that, if possible, no projecting edges extend into the fiber conveying path—although such projections may be tolerated under certain circumstances to influence the orientation of fibers (also in a device according to FIG. 1).

Upon completion of the stopping process, the fork 93 releases the stop 50 again so that the rotor cover 670 returns into its position I under the effect of the compression spring 672.

In yet another alternative variant of the process (not shown), and independently of whether the gap between the open rotor edge and the rotor cover 7 or 670 is enlarged or not, provisions are made for the air stream fed to the suction air connection piece 610 to be intensified. For this purpose it is possible to provide for a reversing valve (not shown) in the suction air channel going to the source of negative pressure 610, such valve connecting, in one position, the housing 60 to a first suction channel in which the negative pressure required for spinning is readied and, in another position, connecting housing 60 to a second suction channel (not shown) creating a greater negative pressure. If the housing 60 is connected to this second suction channel having increased negative pressure in preparation of piecing in order to evacuate the fibers, a more intensive air flow is also produced also in fiber feeding channel 30, or in its segment 301, so that the fibers coming out of the fiber feeding channel 30, or its segment 301, are better able to follow the suction air flow and are thereby prevented from collecting in the fiber collection groove of the spinning rotor 4.

The degree to which the rotor cover 7 (FIGS. 1, 3 and 4) or 670 (FIG. 2) is opened substantially influences the evacuation of fibers into the suction air connection piece 61. For this reason it is possible to control the quantity of fibers fed to the suction air connection piece 61 and, thereby, also the quantity fed to the fiber collection groove 40 by moving rotor cover 7 or 670 into its operating position (position I) from its fiber evacuation position (position II) in a gradual, controlled manner. This results in a division of the fiber stream leaving the fiber feeding channel 30. This is of special advantage for piecing. When the yarn is again drawn off, after piecing, the yarn to the fiber ring which is again forming in the spinning rotor 4, it can be drawn off with an only gradual acceleration to avoid excessive tension in the yarn and/or to avoid difficulties associated with the inertia of the masses to be accelerated, e.g. the mass of the bobbin. If the fiber stream is, however, fed immediately and entirely back to the fiber collection groove 40 when the rotor cover 7 or 670 is brought back, a greater amount of fibers go momentarily into the spinning rotor than can be incorporated into the yarn and drawn off in its acceleration phase. Thus, a thick spot develops in the piecing joint or in the yarn area following it. If, however, the rotor cover 7 or 670 is brought back from its fiber feeding position (position II) into its operating position (position I) in a controlled, i.e. only slow and possibly even non-linear manner, in adaptation to the acceleration of the newly pieced yarn which is now again in the process of being drawn off, so that the fiber mass reaching the fiber groove is substantially of the same size as the fiber mass which is drawn off at the same time by the yarn, such thick spots are avoided.

In order to control the portion of the fiber stream which is deposited in the spinning rotor 4 in adaptation to the yarn draw-off acceleration, it is possible to alternatively or additionally provide for the intensity of the auxiliary air stream flowing into the housing 60 to be reduced in a controlled manner. In the case of the embodiment shown in FIGS. 3 and 4, this occurs simultaneously with the closing movement of the rotor cover 670 and by means of it. Otherwise a suitably controllable choker valve (not shown) can be installed in the channel feeding the auxiliary air.

The piecing control, and thereby also the control of the fiber evacuation in preparation of piecing by means of a piecing apparatus 9 has been described above. It should be understood, however, that in the absence of a piecing apparatus 9 capable of traveling alongside the rotor spinning machine, the aggregates and elements which are necessary for piecing and for the control of the fiber flow can also be stationary and installed at the (or at every) spinning station.

Figure 5:
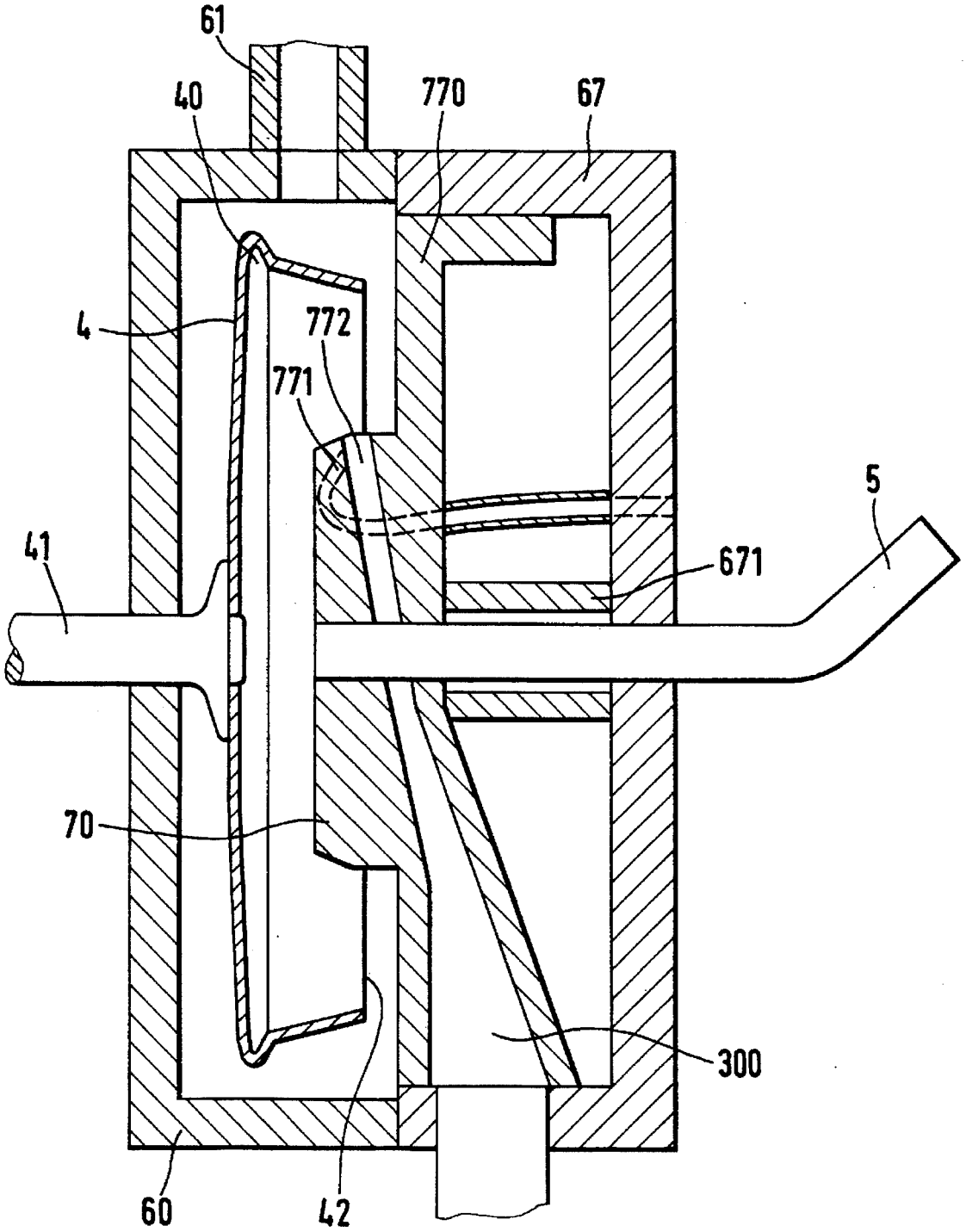
FIG. 5 is a partial cross-sectional representation of a rotor housing assembly according to the present invention.

FIG. 5 shows another example of an embodiment of the invention. A rotor cover 770 is provided with a fiber feeding channel 772. Shortly before the outlet of the fiber feeding channel 772, a compressed-air nozzle 771 is provided. The compressed-air nozzle 771 is provided with a supply channel which lets out at the cover 67. From there it can be subjected to compressed air by means of a source of compressed air (not shown). The source of compressed air can be moved towards the supply channel. The compressed-air nozzle 771 is inclined towards the outlet of the fiber feeding channel 772. The nozzle thereby causes a fiber and air stream coming out of the outlet of the fiber feeding channel 771 to be subjected to additional compressed air and to be deflected in such manner that the fiber stream, as well as the air stream, are deflected out of the interior of the rotor. The fiber stream and air stream are taken out of the housing via suction air connection piece 61. The control of the compressed-air application can be located either at every spinning station or on the spinning machine, or on a traveling piecing apparatus which is not shown. In the latter case, the control device is brought to every spinning station on which a piecing process is to be carried out. The control device has an active connection to a superimposed control device which controls the beginning and end of the compressed-air application and the return of the yarn end.

It will be apparent to those skilled in the art that various modifications can be made in the present invention without departing from the scope or spirit of the invention. For example, features illustrated or described as part of one embodiment may be used on another embodiment to yield a still further embodiment. It is intended that the present invention cover such modifications and variations as come within the scope of the appended claims and their equivalents.

We claim:

1. A method for piecing yarn when fiber feeding has been stopped on an open-end rotor spinning device having an open-end spinning rotor that has been stopped prior to piecing, a fiber feed channel configured to direct a fiber flow from an opener roller to the spinning rotor, and a negative pressure source configured to apply negative pressure to the area of the spinning rotor, wherein during normal spinning operations an air flow is generated with the negative pressure source from the opener roller through the fiber feed channel to the spinning rotor and over an open annular edge of the spinning rotor, a fiber sliver is fed to the opener roller to generate a fiber flow of individual fibers that is combined with the air flow, and fibers are collected from the air flow by the spinning rotor, said method comprising the steps of:

creating negative pressure in an area proximate the spinning rotor to create an air flow from the opener roller through the fiber feed channel to the spinning rotor and over the open edge of the spinning rotor:

rotating the spinning rotor;

feeding a fiber sliver to the opener roller to generate a fiber flow of individual fibers combined with the air flow to the spinning rotor;

diverting the fiber flow out of the spinning rotor to a piecing flow path so that fibers are carried by the air flow over the open edge of the spinning rotor and are collected by the spinning rotor;

backfeeding a yarn end through a yarn draw-off channel into the spinning rotor; and returning the fiber flow from the piecing flow path to the spinning rotor such that fibers are collected in the spinning rotor to incorporate the fibers into the yarn end.

2. The method as in claim 1, wherein said fiber flow diverting step includes conveying a rotor cover, that at least partially defines the fiber feed channel, from an operating position adjacent a rotor housing in which the spinning rotor is disposed, to a fiber evacuation position spaced apart from the rotor housing while maintaining a sealing engagement between the rotor housing and the rotor cover, thereby bundling the air flow exiting the fiber feed channel and facilitating diversion of the fiber flow.

3. The method as in claim 1, wherein said fiber flow diverting step includes altering the fiber feed channel by conveying a rotor cover, that at least partially defines the fiber feed channel, from an operating position adjacent a rotor housing in which the spinning rotor is disposed to a fiber evacuation position spaced apart from the rotor housing to facilitate access of the fiber flow from the fiber feed channel to the negative pressure source.

4. The method as in claim 1, including the step of cleaning the spinning rotor of fibers prior to said backfeeding.

5. The method as in claim 1, wherein said fiber flow diverting step includes introducing an auxiliary air stream into the spinning rotor area to combine with the air flow and facilitate diversion of the fiber flow away from the interior of the spinning rotor.

6. A method for piecing yarn when fiber feeding has been stopped on an open-end rotor spinning device having an open-end spinning rotor that has been stopped prior to piecing, a fiber feed channel configured to direct a fiber flow from an opener roller to the spinning rotor, and a negative pressure source configured to apply negative pressure to the area of the spinning rotor, wherein during normal spinning operations an air flow is generated with the negative pressure source from the opener roller through the fiber feed channel to the spinning rotor and over an open annular edge of the spinning rotor, a fiber sliver is fed to the opener roller to generate a fiber flow of individual fibers that is combined with the air flow, and fibers are collected from the air flow by the spinning rotor, said method comprising the steps of:

creating negative pressure in an are approximate the spinning rotor to create an air flow from the opener roller through the fiber feed channel to the spinning rotor and over the open edge of the spinning rotor;

rotating the spinning rotor;

feeding a fiber sliver to the opener roller to generate a fiber flow of individual fibers combined with the air flow to the spinning rotor;

diverting the fiber flow out of the spinning rotor to a piecing flow path, in which fibers are carried by the air flow over the open edge of the spinning rotor and are not collected by the spinning rotor, by conveying a rotor cover, that at least partially defines the fiber feed channel, from an operating position adjacent a rotor housing in which the spinning rotor is disposed, to a fiber evacuation position spaced apart from the rotor housing while maintaining a sealing engagement between the rotor housing and the rotor cover, thereby bundling the air flow exiting the fiber feed channel and facilitating diversion of the fiber flow;

backfeeding a yarn end through a yarn draw-off channel into the spinning rotor; and returning the fiber flow from the piecing flow path to the spinning rotor by conveying the rotor cover from the evacuation position to the operating position such that fibers are collected in the spinning rotor to incorporate the fibers into the yarn end.

7. The method as in claim 6, wherein the fiber evacuation position permits an auxiliary air stream to flow into the housing in a manner such as to reduce velocity of the fiber flow and the momentum of the fibers therein and to facilitate diversion of the fiber flow.

8. The method as in claim 6, wherein said fiber flow diverting step includes altering the fiber feed channel by conveying the rotor cover from the operating position to the fiber evacuation position to facilitate access of the fiber flow from the fiber feed channel to the negative pressure source.

9. The method as in claim 6, wherein the yarn end is back-fed to the spinning rotor synchronously with said returning of the fiber flow to the spinning rotor so that a uniform piecing joint is obtained.

10. The method as in claim 6, wherein said fiber flow diverting step includes introducing an auxiliary air stream into the spinning rotor area to cooperate with the air flow and the fiber flow away from the interior of the spinning rotor.

11. The method as in claim 10, wherein the auxiliary air stream is introduced into the spinning rotor area substantially in the direction of the fiber flow from the fiber feed channel.

12. The method as in claim 10 wherein said returning of the fiber flow to the spinning rotor includes reducing the auxiliary air stream at a predetermined rate synchronized with the rate of acceleration of yarn withdrawal from the yarn draw-off channel such that a consistent yarn is drawn from the spinning rotor.

13. The method as in claim 6, wherein said fiber flow diverting step includes increasing negative pressure in the spinning rotor area from the negative pressure source.

14. The method as in claim 6, wherein the air flow created at said negative pressure creating step is oriented substantially in the direction of the fiber flow leaving the fiber feed channel.

15. The method as in claim 6, including introducing the fiber flow into the interior of the rotor housing generally parallel to a plane defined by a fiber collection surface of the spinning rotor.

16. The method as in claim 6, wherein said returning of the fiber flow to the spinning rotor is synchronized with the rate of acceleration of yarn withdrawal from the yarn draw-off channel such that a uniform piecing joint is obtained.

17. The method as in claim 6, wherein said fiber flow diverting step includes directing a compressed air stream into the air flow at the outlet of the fiber feed channel and in a direction out of the spinning rotor, and wherein said fiber flow returning step includes reducing the compressed air stream.

18. The method as in claim 17, wherein said fiber flow returning step includes terminating the compressed air stream.

19. An apparatus for piecing yarn when fiber feeding has been stopped on an open-end spinning machine including an open-end spinning rotor having an open annular edge, an opener roller upstream from the spinning rotor, the opener roller configured to separate individual fibers from a fiber sliver, a sliver feeding device upstream from the opener roller, a fiber feeding channel configured to direct separated fibers from the opener roller to the spinning rotor, a negative pressure source in operative communication with the spinning rotor area, and a yarn draw-off channel configured to convey spun yarn from the spinning rotor, wherein during normal spinning operations an air flow is generated with the negative pressure source from the opener roller through the fiber feed channel into the spinning rotor and to the negative pressure source, a fiber sliver is fed to the opener roller to generate a fiber flow that is combined with the air flow, and fibers are collected from the fiber flow by the spinning rotor, said apparatus comprising:

a fiber flow diversion mechanism in communication with the spinning rotor area and configured to divert fiber flow exiting the fiber feed channel from its normal spinning operational flow path into said spinning rotor to a piecing flow path such that fibers are carried by the air flow over the pen edge of the spinning rotor and are not collected by the spinning rotor;

a control device in operative communication with said fiber flow diversion mechanism and the sliver feeding device, said control device configured to initiate diversion by said fiber flow diversion mechanism of the fiber flow exiting the fiber feed channel and to initiate feeding of a fiber sliver by the feeding device to the opener roller for separation of the fiber sliver into individual fibers to generate a fiber flow combined with the air flow, and to subsequently re-divert said fiber flow into said spinning rotor for piecing; and a yarn back-feeding mechanism configured to back feed a yarn end through said yarn draw-off channel into said spinning rotor for piecing so that fibers from said re-diverted fiber flow are incorporated into said yarn end in said spinning rotor.

20. The apparatus as in claim 19, wherein said fiber flow diversion mechanism is also configured to return, responsively to said control device, the fiber flow from the piecing path to the spinning rotor so that fibers are collected in the spinning rotor to incorporate the fibers into a yarn end back-fed to the spinning rotor through the yarn draw-off channel.

21. The apparatus as in claim 20, wherein said fiber flow diversion mechanism includes an opening mechanism configured to convey a rotor cover between an operating position adjacent a rotor housing in which the spinning rotor is disposed and a fiber evacuation position spaced apart from the rotor housing while maintaining a sealing engagement between said rotor housing and said rotor cover, and wherein said opening mechanism is configured to convey, responsively to said control device, the rotor cover to the fiber evacuation position to divert the fiber flow, and to convey, responsively to said control device, the rotor cover to the operating position to return the fiber flow to the spinning rotor.

22. The apparatus as in claim 20, wherein said fiber flow diversion mechanism is configured to introduce an auxiliary air stream into the spinning rotor area during the fiber flow diversion via an auxiliary air passage and to reduce the auxiliary air stream during the return of the fiber flow to the spinning rotor.

23. The apparatus in claim 20, wherein said fiber flow diversion mechanism is configured to introduce an auxiliary air stream into the spinning rotor area via an auxiliary air passage having an outlet adjacent the outlet of the fiber feed channel to divert the air flow from its normal spinning operational flow path, and to reduce the auxiliary air stream during return of the fiber flow to the spinning rotor.

24. An open end spinning machine, said machine comprising:

an open-end spinning rotor having an open annular edge;

an opener roller upstream from said spinning rotor, said opener roller configured to separate individual fibers from a fiber sliver;

a sliver feeding device upstream from said opener roller;

a fiber feed channel extending from, and configured to direct separated fibers from, said opener roller to said spinning rotor;

a negative pressure source in operative communication with the spinning rotor area, said negative pressure source configured to apply negative pressure to said spinning rotor area to generate an air flow and a fiber flow during normal spinning operations from said opener roller through said fiber feed channel to said spinning rotor;

a yarn draw-off channel proximate said spinning rotor and configured to convey spun yarn therefrom;

a fiber flow diversion mechanism in communication with said spinning rotor area and configured to divert fiber flow exiting said fiber feed channel from its normal spinning operational path to a piecing flow path such that fibers are carried by the air flow over said spinning rotor edge and are not collected by the spinning rotor; and a control device in operative communication with said fiber flow diversion mechanism and said sliver feeding device, said control device configured to initiate diversion of the fiber flow exiting said fiber feed channel by said fiber flow diversion mechanism and to initiate feeding of a fiber sliver by said feeding device to said opener roller for separation of the fiber sliver into individual fibers to generate a fiber flow combined with the air flow.

25. The machine as in claim 24, wherein said fiber flow diversion mechanism is also configured to return, responsively to said control device, the fiber flow from the piecing path to the spinning rotor so that fibers are collected in said spinning rotor to incorporate the fibers into a yarn end back-fed to said spinning rotor through said yarn draw-off channel.

26. The machine as in claim 25, including a rotor cover adjacent a rotor housing, in which said spinning rotor is disposed, in an operating position and configured to be conveyed therefrom to a fiber evacuation position spaced apart from said rotor housing, and wherein said fiber flow diversion mechanism includes an opening mechanism in communication with said rotor cover and configured to convey, responsively to said control device, said rotor cover to the fiber evacuation position, and to convey, responsively to said control device, said rotor cover to the operating position to return the fiber flow to said spinning rotor.

27. The machine as in claim 26, including a seal means configured to maintain a sealed condition between said rotor housing and said rotor cover at and between the operating position and the fiber evacuation position.

28. The machine as in claim 26, wherein said fiber feed channel extends at least partially through an opener housing, in which said opener roller is disposed, and said rotor cover and wherein said rotor cover and said opener housing are slidably and sealingly engaged at a fiber feed channel interface therebetween.

29. The machine as in claim 28, wherein said feeding channel at said feeding channel interface defines an outlet from said opener housing and an inlet to said rotor cover and wherein said inlet and outlet are configured such that the entirety of said outlet opens to said inlet as said rotor cover is positioned at and between the operating position and the fiber evacuation position.

30. The machine as in claim 29, including seal means configured to maintain a sealed condition between said rotor cover and said rotor housing at and between the operating position and the fiber evacuation position.

31. The machine as in claim 30, wherein said seal means includes a first seal disposed in said rotor housing and a second seal disposed in said rotor cover, said first seal and said second seal configured to engage one another as said rotor cover is conveyed between the operating position and the fiber evacuation position.

32. The machine as in claim 31, wherein at least one of said first seal and said second seal is a lip seal.

33. The machine as in claim 32, wherein said rotor housing and said rotor cover each define a snap ring groove receiving a corresponding said lip seal, and including an auxiliary air passage extending into said rotor housing interior to introduce an auxiliary air stream thereto during diversion of the fiber flow from ins normal operational flow path, said auxiliary air passage extending through one of said snap ring grooves such that said corresponding lip seal blocks said auxiliary air passage when said rotor cover is in the operating position and opens said auxiliary air passage when said rotor cover is in the fiber evacuation position.

34. The machine as in claim 26, including an auxiliary air passage extending through at least one of said rotor housing and said rotor cover into the rotor housing interior to introduce an auxiliary air stream thereto during diversion of the air flow from its normal operational flow path.

35. The machine as in claim 34, wherein said auxiliary air passage includes an outlet to said rotor housing interior, said outlet located generally behind an outlet of said fiber feed channel into said rotor housing interior relative to said negative pressure source.

36. The machine as in claim 34, wherein said fiber feed channel extends at least partially through said rotor cover such that said fiber feed channel is altered when said rotor cover is conveyed to the fiber evacuation position to facilitate access of the air flow and fiber flow from the fiber feed channel to said negative pressure source.

37. The machine as in claim 26, including a second rotor housing, said second rotor housing engaging said first rotor housing and receiving said rotor cover.

38. The machine as in claim 25, including an auxiliary air passage having an outlet to said spinning rotor area, wherein said fiber flow diversion mechanism is configured to introduce an auxiliary air stream into said spinning rotor area during the fiber flow diversion via said auxiliary air passage, and to reduce the auxiliary air stream during the return of the fiber flow to said spinning rotor.

39. The machine as in claim 24, including an auxiliary air passage extending through at least one of a rotor housing in which said spinning rotor is disposed and a rotor cover adjacent said rotor housing in an operating position, said auxiliary air passage having an outlet to the rotor housing interior adjacent the outlet of said fiber feed channel for introducing an auxiliary air stream into the air flow from said fiber feed channel to direct the combined air flow and fiber flow out of the spinning rotor interior.

40. The machine as in claim 39, wherein said auxiliary air passage introduces the auxiliary air stream into the air flow and the fiber flow responsively to said control device.

41. The machine as in claim 39, wherein said auxiliary air passage is configured such that the auxiliary air stream is directed from the spinning rotor interior to said open annular edge.

42. The machine as in claim 24, wherein said fiber feed channel includes an outlet to said spinning rotor area, said outlet oriented generally parallel to a plane defined by a fiber collection surface of said spinning rotor.

43. The machine as in claim 24, wherein said fiber flow diversion mechanism includes means for increasing negative pressure from the negative pressure source on said spinning rotor area.

44. The machine as in claim 24, including a cleaning mechanism adjacent said spinning rotor and configured to clean said spinning rotor of fibers.

* * * * *